US009528342B2

(12) United States Patent
Xu et al.

(10) Patent No.: US 9,528,342 B2
(45) Date of Patent: Dec. 27, 2016

(54) METHOD OF SETTING AND MAINTAINING A TOOL IN A SET POSITION FOR A PERIOD OF TIME

(71) Applicants: Yingqing Xu, Tomball, TX (US); Zhiyue Xu, Cypress, TX (US)

(72) Inventors: Yingqing Xu, Tomball, TX (US); Zhiyue Xu, Cypress, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 637 days.

(21) Appl. No.: 13/975,557

(22) Filed: Aug. 26, 2013

(65) Prior Publication Data

US 2015/0053428 A1 Feb. 26, 2015

(51) Int. Cl.
*E21B 33/129* (2006.01)
*E21B 33/128* (2006.01)

(52) U.S. Cl.
CPC ..... *E21B 33/1293* (2013.01); *E21B 33/128* (2013.01)

(58) Field of Classification Search
CPC ..... E21B 23/00; E21B 23/02; E21B 23/06; E21B 29/00; E21B 33/12; E21B 33/128; E21B 33/1293
See application file for complete search history.

(56) References Cited

U.S. PATENT DOCUMENTS

| | | | | |
|---|---|---|---|---|
| 5,743,333 | A | 4/1998 | Willauer et al. | |
| 2005/0189103 | A1 | 9/2005 | Roberts et al. | |
| 2005/0205264 | A1 | 9/2005 | Starr et al. | |
| 2008/0066923 | A1* | 3/2008 | Xu | E21B 23/00 166/376 |
| 2011/0048743 | A1 | 3/2011 | Stafford et al. | |

OTHER PUBLICATIONS

Zhihui Zhang et al., "High Strength Nanostructured Materials and Their Oil Field Applications"; Society of Petroleum Engineers; Conference Paper SPE 157092; Oilfield Nanotechnology Conference, 2012; pp. 1-6.

Notification of Transmittal of the International Search Report and the Written Opinion of the International Searching Authority; PCT/US2014/047794; Mailed Nov. 24, 2014; Korean Intellecutal Property Office; 15 pages.

* cited by examiner

*Primary Examiner* — Yong-Suk (Philip) Ro
(74) *Attorney, Agent, or Firm* — Cantor Colburn LLP

(57) ABSTRACT

A method of setting and maintaining a tool in a set position for a period of time includes the following. Causing a component of a device to move relative to another component of the device, interengaging one or more features of at least one of the components with the another component, creating a set condition of a tool engaged with the component and the another component with the causing and interengaging. A method of dissolving at least the one or more features when removal of the tool is desired.

20 Claims, 1 Drawing Sheet

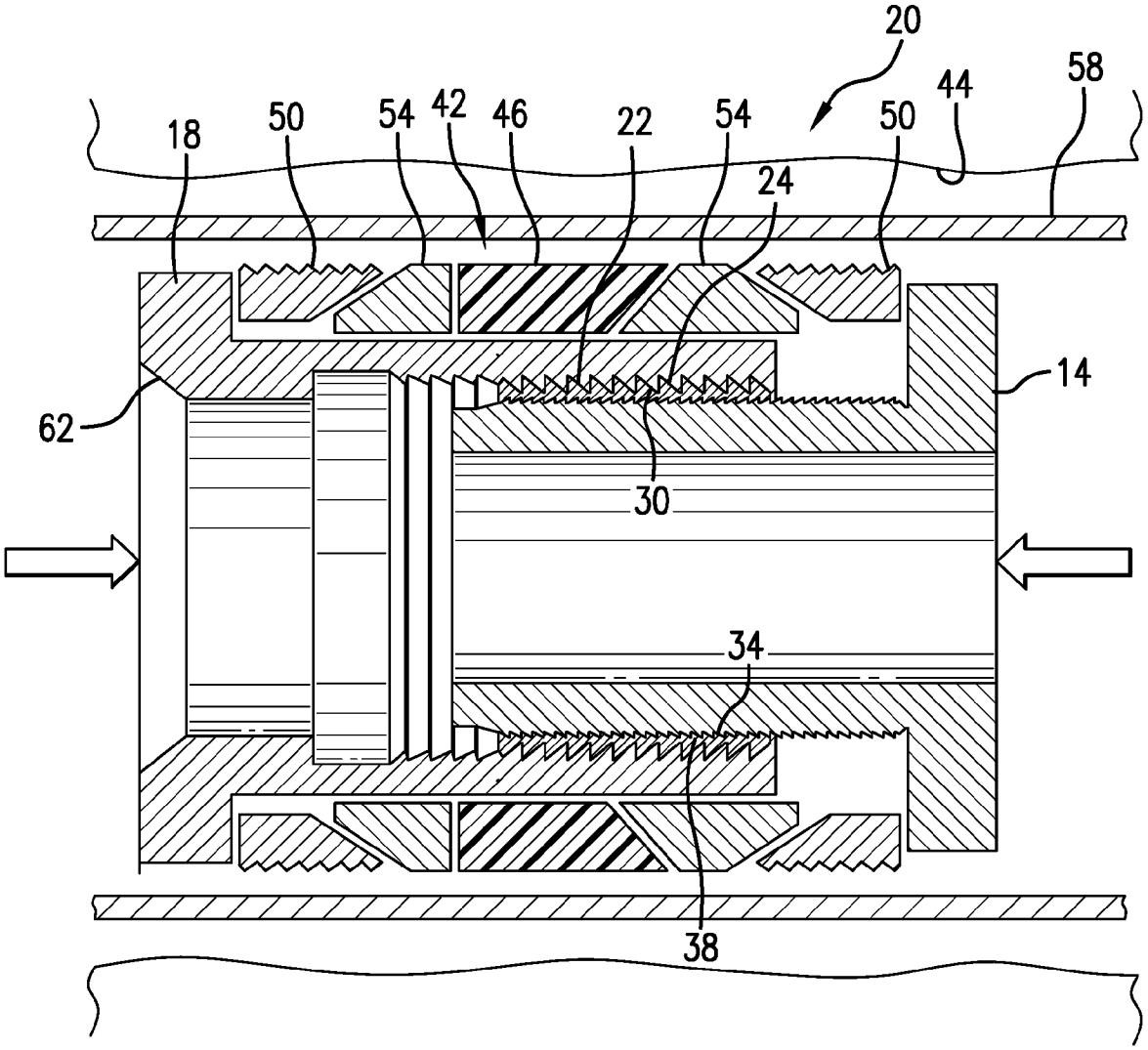
58
44
20
50
54
24
22
46
42
54
50
18
62
14
30
34
38

METHOD OF SETTING AND MAINTAINING A TOOL IN A SET POSITION FOR A PERIOD OF TIME

BACKGROUND

Devices have been available for some time for setting a tool within a tubular such as in the downhole hydrocarbon and carbon sequestration industries. Likewise, there are devices for maintaining a tool in the set position. Though these devices work well for the purpose for which they were designed, the process for disengaging set tools and the devices that maintain the tools in the set position once the tools are no longer needed can be costly in both time and money. Disengagement of such devices from the respective tools can in some cases require running a shifting tool or a cutting tool to the device before it can be disengaged. In some cases, this might require an additional dedicated run in the hole with attendant delays and monetary costs. Those who practice in the art will therefore be receptive to methods that overcome the foregoing drawbacks.

BRIEF DESCRIPTION

Disclosed herein is a method of setting and maintaining a tool in a set position for a period of time. The method includes causing a component of a device to move relative to another component of the device, interengaging one or more features of at least one of the components with the another component, creating a set condition of a tool engaged with the component and the another component with the causing and interengaging, and when removal of the tool is desired, dissolving at least the one or more features.

BRIEF DESCRIPTION OF THE DRAWINGS

The following descriptions should not be considered limiting in any way. With reference to the accompanying drawings, like elements are numbered alike:

FIG. 1 depicts a cross sectional view of a portion of a setting device disclosed herein.

DETAILED DESCRIPTION

A detailed description of one or more embodiments of the disclosed apparatus and method are presented herein by way of exemplification and not limitation with reference to the FIGURES.

Referring to FIG. 1 a portion of one embodiment of a setting device is illustrated at 20. The portion of the setting device 20 includes at least a first component illustrated herein as a mandrel 14, a second component illustrated herein as a housing 18 and a third component illustrated herein as a body lock ring 22. All three of the components 14, 18 and 22 include features 24, 30, 34 and 38 that are interengagable with one another to allow relative movement of at least the mandrel 14 relative to the housing 18 in a first direction while preventing movement in an opposing direction. In this embodiments the features 24, 30, 34 and 38 are teeth. Specifically, the body lock ring 22 has the teeth 24 that face radially outwardly and engage with the teeth 30 that face radially inwardly on the housing 18. The body lock ring 22 also has the teeth 34 that face radially inwardly and engage with the teeth 38 that face radially outwardly on the mandrel 14. The optional body lock ring 22 is C shaped due to a longitudinal opening (not visible in the FIGURE) that extends longitudinally through the body lock ring 22. This allows the body lock ring 22 to flex which action changes a radial size of the body lock ring 22 to thereby allow the teeth 34 thereon to ratchet relative to the teeth 38 when the mandrel 14 is pushed longitudinally toward the housing 18. This ratcheting engagement, while allowing longitudinal movement of the mandrel 14 towards the housing 18 prevents movement of the mandrel 14 in a longitudinal direction away from the housing 18 thereby discouraging unsetting of the device 20.

In an embodiment, one or more portions of the mandrel 14, the housing 18 and the body lock ring 22 are configured to dissolve in a set time period after being exposed to a target natural or created environment. The dissolution causes the teeth 24 of the body lock ring 22 to become disengaged with teeth 30 of the housing 18 or the teeth 34 of the body lock ring 22 to become disengaged with teeth 38 of the mandrel 22, or both. In one embodiment, the whole of the teeth 24, 30, 34, 38 are configured to dissolve while in other embodiments only portions of the mandrel 14, the housing 18 and the body lock ring 22 are configured to dissolve. More specifically, in an embodiment only one or more sets of the teeth 24, 30, 34, 38 may be configured to dissolve. Proportionally to the volume of dissolvable components, the ease of removal of the tool 42 will increase. Once the teeth 24, 30, 34, 38 are disengaged, the mandrel 14 and the housing 18 can move longitudinally away from one another allowing them to separate. This of course removes longitudinal compression of a tool 42, such as a packer illustrated in the FIGURE, consequently releasing the packer.

The foregoing device 20 allows an operator to set the tool 42 by longitudinally compressing the tool 42 between the mandrel 14 and the housing 18 and to maintain the tool 42 in the set position for a set period of time. The period of time may be established by the time required before dissolution of at least one of the mandrel 14, the housing 18 and the body lock ring 22 sufficiently to disengage the teeth 24 or 34 from the teeth 30 or 38.

The mandrel 14, the housing 18 and the body lock ring 22 can be constructed of metals and metal alloys that are configured to dissolve upon exposure to certain environments including specific fluids, temperatures and pressures, for example. The fluids can include fluids anticipated to be encountered in a downhole environment such as, oil, water, brine and combinations of the foregoing or fluids that are applied to the environment having at least a purpose of dissolving the components. As such, for applications wherein the setting device 20 is employed in an earth formation borehole 44 such as during a hydrocarbon recovery or carbon dioxide sequestration operation, for example, the dissolution of the metals can be initiated by entry into the borehole 44. Alternately, dissolution can be initiated after exposing the setting device 10 to a selected fluid that is pumped to the location of the setting device 20. Fluids such as acids and bases that may not occur naturally in the borehole 44 can allow additional control over timing of dissolution since the dissolution would not begin until the selected fluid is introduced to the location of the setting device 20.

In such borehole 44 applications, among other things the tool 42 may include seals 46, slips 50 and cones 54 to allow the setting device 20 to establish and maintain sealing and anchoring of the tool 42 to a casing 58, liner, or other structure within the borehole 44, for example. In applications wherein the tool 42 is a fracing plug a seat 62 can be included on the housing 18 (or the mandrel 14) for seating of a plug (not shown) such as a ball to allow pressure to build thereagainst to perform a treating operation such as a fracing or a formation chemical treating operation.

The material and/or the geometry of the mandrel 14, housing 18 and the body lock ring 22 as well as the fluid to cause dissolution thereof can be selected to control a rate of dissolution. In so doing, the setting device 20 can be configured to maintain the tool 42 in the set configuration until after any operations that require the tool 42 be set are completed.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method of setting and maintaining a tool in a set position for a period of time in a borehole, comprising:

causing a component of a device to move in a first direction relative to another component of the device during setting of the tool;

interengaging one or more features of the component with the another component during the relative movement;

creating a set condition of the tool engaged with the component and the another component with the causing and interengaging;

and during unsetting of the tool, dissolving at least the one or more features and allowing the component and the another component to move in a second direction opposite the first direction relative to each other.

2. The method of setting and maintaining a tool in a set position for a period of time of claim 1, further comprising disengaging the component from the another component.

3. The method of setting and maintaining a tool in a set position for a period of time of claim 2, further comprising setting a dissolution rate that results in the disengaging occurring after a selected period of time.

4. The method of setting and maintaining a tool in a set position for a period of time of claim 3, wherein the selected period of time is after an operation has been completed.

5. The method of setting and maintaining a tool in a set position for a period of time of claim 4, wherein the operation is one of fracing or treating a formation.

6. The method of setting and maintaining a tool in a set position for a period of time of claim 3, wherein the setting a dissolution rate is at least in part done through selection of material of the component or the another component.

7. The method of setting and maintaining a tool in a set position for a period of time of claim 3, wherein the setting a dissolution rate is at least in part done through selection of geometric parameters of the component or the another component.

8. The method of setting and maintaining a tool in a set position for a period of time of claim 1, further comprising exposing at least the one or more features to a fluid configured to dissolve the at least the one or more features.

9. The method of setting and maintaining a tool in a set position for a period of time of claim 1, further comprising exposing at least the one or more features to a fluid configured to dissolve the at least the component or the another component.

10. The method of setting and maintaining a tool in a set position for a period of time of claim 1, wherein the movement of the component relative to the another component is longitudinal movement.

11. The method of setting and maintaining a tool in a set position for a period of time of claim 1, further comprising longitudinally compressing the tool between the component and the another component.

12. The method of setting and maintaining a tool in a set position for a period of time of claim 1, further comprising ratchetingly engaging the one or more features of the component with the another component.

13. The method of setting and maintaining a tool in a set position for a period of time of claim 1, wherein the one or more features are teeth.

14. The method of setting and maintaining a tool in a set position for a period of time of claim 1, wherein the interengaging one or more features of the component with the another component includes interengaging a third component with each of the component and the another component.

15. The method of setting and maintaining a tool in a set position for a period of time of claim 14, wherein the component, the another component and the third component are a mandrel, a housing and a body lock ring.

16. The method of setting and maintaining a tool in a set position for a period of time of claim 1, further comprising radially moving at least a portion of the tool with the movement of the component relative to the another component.

17. The method of setting and maintaining a tool in a set position for a period of time of claim 1, wherein the creating a set condition includes setting slips.

18. The method of setting and maintaining a tool in a set position for a period of time of claim 1, wherein the creating a set condition includes setting seals.

19. The method of setting and maintaining a tool in a set position for a period of time of claim 1, wherein the tool includes a frac seat.

20. The method of setting and maintaining a tool in a set position for a period of time of claim 1, wherein the tool is a packer.

* * * * *